US006113368A

United States Patent [19]

Hofmann

[11] Patent Number: 6,113,368

[45] Date of Patent: Sep. 5, 2000

[54] METHOD FOR SUPPLYING LIQUIDS BY MEANS OF A PUMP COMBINATION COMPRISING OF TWO SINGLE OSCILLATING DISPLACEMENT PUMPS, AND DEVICE FOR ACCOMPLISHING THE METHOD

[75] Inventor: Frank Hofmann, Hamburg, Germany

[73] Assignee: Walter Hofmann GmbH, Rellingen, Germany

[21] Appl. No.: 09/105,949

[22] Filed: Jun. 26, 1998

[30] Foreign Application Priority Data

Jun. 28, 1997 [DE] Germany ..... 197 27 623

[51] Int. Cl.[7] ..... F04B 11/00

[52] U.S. Cl. ..... 417/539; 417/53

[58] Field of Search ..... 417/539, 53, 403, 417/401, 900; 91/189 R, 191, 193

[56] References Cited

U.S. PATENT DOCUMENTS

| | | | |
|---|---|---|---|
| 1,450,400 | 4/1923 | Wolff . | |
| 2,141,731 | 12/1938 | Wolfrom et al. | 91/193 X |
| 4,127,360 | 11/1978 | Carpenter . | |
| 4,191,309 | 3/1980 | Alley . | |
| 4,321,014 | 3/1982 | Eburn, Jr. et al. | 417/539 |
| 4,359,312 | 11/1982 | Funke et al. | 417/18 |
| 4,666,374 | 5/1987 | Nelson | 417/53 X |
| 4,808,077 | 2/1989 | Kan et al. | 417/53 X |
| 5,141,408 | 8/1992 | Conrad . | |
| 5,222,873 | 6/1993 | Whitehead et al. | 91/189 R X |
| 5,634,779 | 6/1997 | Eysymontt | 417/342 |
| 5,755,561 | 5/1998 | Coulliard et al. | 417/426 |

FOREIGN PATENT DOCUMENTS 1450400 9/1976 United Kingdom .

*Primary Examiner*—Charles G. Freay
*Assistant Examiner*—David J. Torrente
*Attorney, Agent, or Firm*—Hill & Simpson

[57] ABSTRACT

A method and apparatus for supplying liquids by means of a pump combination comprising two single oscillating displacement pumps is provided, wherein a supply pressure of the pump supplying liquid into a user duct is used as a control value of a pressure controller, such that a pressure stroke movement of the other pump which is generating a pre-compression pressure, is discontinued when the pre-compression pressure equals the supply pressure, and the pre-compression pressure is maintained.

9 Claims, 2 Drawing Sheets

METHOD FOR SUPPLYING LIQUIDS BY MEANS OF A PUMP COMBINATION COMPRISING OF TWO SINGLE OSCILLATING DISPLACEMENT PUMPS, AND DEVICE FOR ACCOMPLISHING THE METHOD

BACKGROUND OF THE INVENTION

The invention relates to a method for supplying liquids by means of a pump combination consisting of two single oscillating displacement pumps wherein during the displacement operation of the one pump the other pump is started and pre-compresses the supplied medium with the outlet valve closed, then is stopped while holding the pre-compression final pressure reached, and is continued with its stroke while supplying the supplied medium only when the corresponding other pump ends its supply. Therein the pulsing, when transferring the supply from the one pump to the other, may be kept very small.

Such and similar pumps are known from the documents AU 1 450 400, U.S. Pat. No. 5,141,408, U.S. Pat. No. 4,127,360 and U.S. Pat. No. 4,191,309.

The known single pump comprises a suction stroke which is faster than the compression stroke, such that with movements offset by 180° of the two pumps, a time reserve is present between the end of the suction stroke of the one pump and the beginning of the subsequent supply stroke of the same pump, with the time reserve bridged by a stop of the displacing member after the pre-compression stroke. During the pre-compression stroke, the displacing member performs its pressure stroke with the outlet valve closed, until a required pressure is reached for the pressure medium enclosed in the supplying cylinder, whereupon the movement of the displacing member is stopped while maintaining this pre-compression final pressure.

In the pump described in U.S. Pat. No. 1,450,400, referring to FIGS. 1 and 2, the movement of the displacing members is generated by means of electrical step motors acting upon spindles. During the pre-compression stroke of the one displacing member, the associated step motor is supplied with electrical power which is associated with a slipping torque corresponding with the required final pressure. After having reached the required pressure, the step motor starts to slip while maintaining the pre-compression pressure reached, wherein the displacing member comes to a stand still. When the other single pump supplying to the user reaches the end of its supply stroke, the outlet valve of the single pump standing still and presented with the pre-compression stroke is opened, and simultaneously the electrical power for the step motor is increased, such that this pump continue its pressure stroke while supplying the medium to the user.

The drive unit and the control of this pump system is costly and complicated and there is no automatic adaption or modification of the final pressure of the pre-compression when the supply pressure changes.

In the pump system described in U.S. Pat. No. 5,141,408 the pre-compression pressure is sensed by a pressure sensor. When a preset pressure is reached, the sensor supplies a signal by means of which the drive unit, in this case a hydraulic drive, is deactivated for the hydraulic cylinder driving the displacing member stops. Also, in this case, the final pressure of the pre-compression has to be adjusted to the required value from the outside, and has to be adapted to the supply pressure acting in the ducts to the user.

SUMMARY OF THE INVENTION

It is an object of the invention to provide a method and a device avoiding the above described disadvantages and adapting the final pressure of the pre-compression automatically to the supply pressure present.

According to the invention, the supply pressure of the single pump supplying into the user duct is presented as a control value to that device which discontinues the pressure stroke movement of the other single pump when the pre-compression pressure, defined by the supply pressure, is reached, while maintaining this pressure.

Referring to a drawing for a pump system the displacing members of which are driven by hydraulic cylinders the invention is further described.

DETAILED DESCRIPTION OF THE PREFERRED EMBODIMENTS

Figure 1:
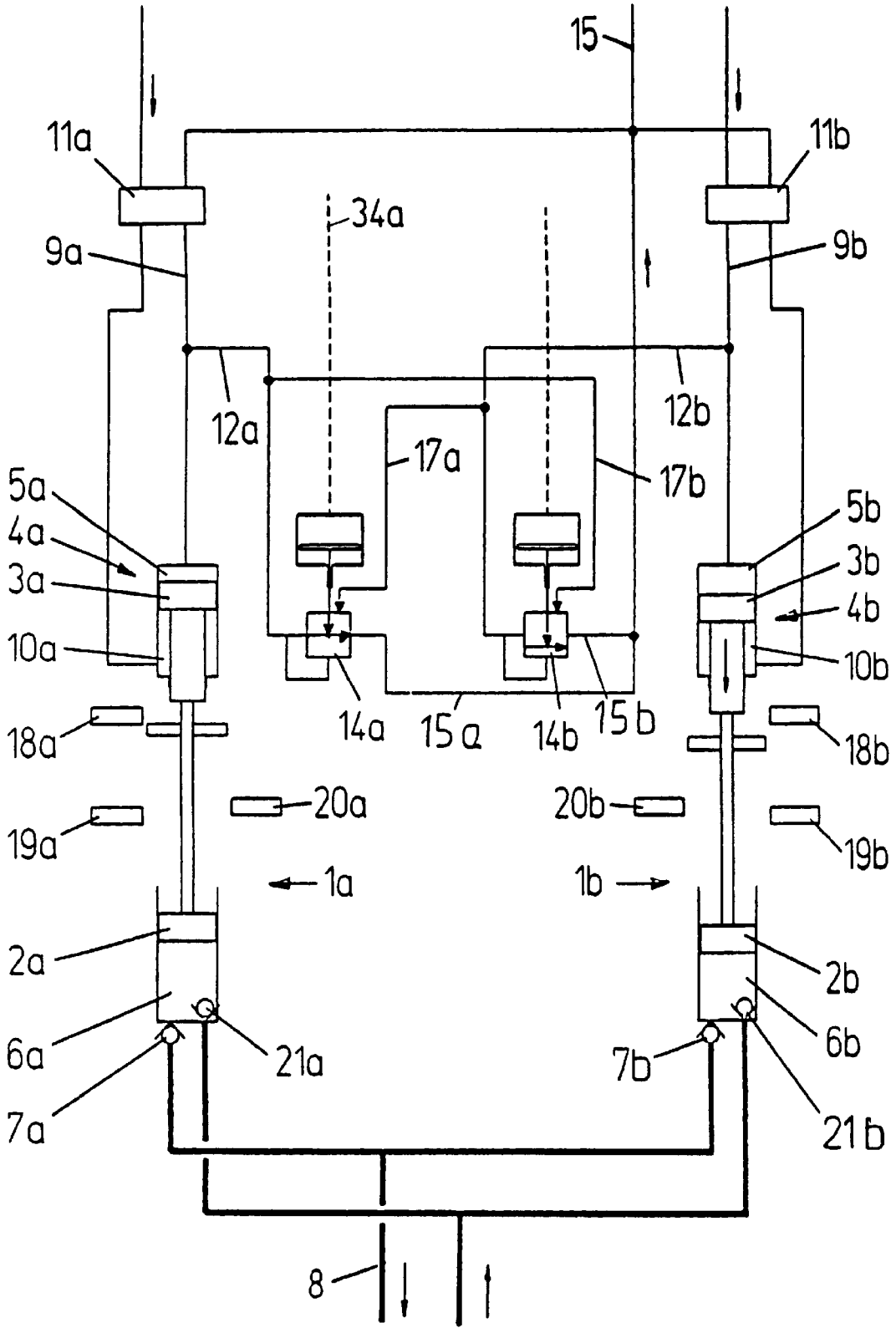
FIG. 1 illustrates the schematic design of the pump combination.

Referring to FIG. 1, two single pumps 1*a*, 1*b* comprise displacing members 2*a*, 2*b* which are connected to pistons 3*a*, 3*b* of hydraulic cylinders 4*a*, 4*b*, such that a movement of the hydraulic pistons 3*a*, 3*b* is transferred to the displacing members 2*a*, 2*b*. When the pistons 3*a*, 3*b* are moved, because oil is supplied to the cylinder chambers 5*a*, 5*b*, the supply medium in the pump chambers 6*a*, 6*b* is compressed, and after having reached a pressure present in a duct 8 to the user, is pressed into the duct 8 through an outlet valve 7*a*, 7*b*. The hydraulic oil is supplied to the cylinder chambers 5*a*, 5*b* through ducts 9*a*, 9*b*. For accomplishing the suction stroke, the hydraulic oil is supplied to the cylinder chambers 10*a*, 10*b*. The control of the oil streams to the cylinder chambers is accomplished by means of valves 11*a*, 11*b*. Each of the two displacing member piston combinations 2*a*, 3*a* and 2*b*, 3*b* oscillate between an upper and a lower dead point. Switches or sensors 18*a*, 18*b* and 19*a*, 19*b* sense the dead points of the corresponding displacing member piston combination and control the oil streams, such that the stroke is reversed by switching the corresponding hydraulic valves 11*a*, 11*b*. The downwards stroke is the pressure or supply stroke, respectively. The upwards stroke is the suction stroke. Closely preceding the switch 19*a*, 19*b*, enacting the switch from the supply stroke to the suction stroke, there is a further switch 20*a*, 20*b*. It is the object of this switch 20*a*, 20*b*, to accomplish a discontinuation of the oil stream through the ducts 12*a* or 12*b*, respectively, to the oil reservoir, and that in the correspondingly other pump standing still at the end of the pre-compression stroke. Therefore the switch 20*a* is dedicated for the discontinuation of the oil stream through the duct 12*b*, and the switch 20*b* is dedicated for the discontinuation of the oil stream through the duct 12*a*.

Ducts 12*a*, 12*b* are connected to the ducts 9*a*, 9*b*. The ducts 12*a*, 12*b* lead to the pressure controllers 14*a*, 14*b*, and therefrom with a common duct 15 through connecting ducts 15*a*, 15*b* back to the hydraulic oil reservoir. The pressure controllers 14*a*, 14*b* are designed such that an oil stream is passed only when a certain pressure is reached, which pressure is defined by the pressure in the cylinder chambers 5*a* or 5*b*, respectively, of the pump 1*a* or 1*b*, respectively, supplying into the duct 8. For this reason, the pressure controllers 14*a*, 14*b* are connected to the cylinder chambers 5*a*, 5*b* with control pressure ducts 17*a*, 17*b*. The pressure controller 14*a* associated with the single pump 1 a is connected with the cylinder chamber 5*b* of the single pump 1*b* through the duct 17*a*, and the pressure controller 14*b* of the pump 1*b* is connected with the cylinder chamber 5*a* of the single pump 1*a* through the duct 17*b*.

The pump 1*b* is illustrated in the supply situation, which means the pump supplies medium through the opened outlet valve 7*b* into the duct 8 to the user. The pressure pre-sent in the cylinder chamber 5*b* and in the ducts 9*b*, 17*a*, and 17*b* depends on the pressure of the supply medium in the pump chamber 6*b*.

The pump 1*a* is illustrated in the stand still position after the pre-compression stroke has ended. The pressure controller 14*a* is in the opened position, such that the hydraulic oil flowing into the duct 9*a* is discharged through the duct 12*a* to the duct 15. Therein the pressure in the duct 9*a*, and in the cylinder chamber 5*a*, and in the pump chamber 6*a*, is maintained at a level by the pressure controller 14*a*, which is defined by the geometrical conditions in the pressure controller 14*a*, and the pressure present in the cylinder chamber 5*b* of the pump 1*b* acting as a control pressure through the duct 17*b* onto the pressure controller.

When the displacing member 2*b* performing the supply stroke reaches the switch or sensor 20*b*, the discontinuation of the oil stream through the duct 12*a* is performed by the switch or sensor. This may be accomplished in different ways. In the example illustrated, the discontinuation is enacted by supplying an additional force onto the valve slider of the pressure controller 14*a*, whereupon the pressure controller is closed. Thereupon the displacing member 2*a* will continue with the pressure stroke, now as a supply stroke, wherein supply medium is pressed through the opening outlet valve 7*a* into the duct 8 to the user.

When the displacing member at the end of its supply stroke reaches the lower dead point, the suction stroke is triggered by the switch 19*b*, whereupon the outlet valve 7*b* will close, and the supply medium flows into the chamber 6*b* through an opening inlet valve 21*b*.

While the displacing member 2*a* now is in its supply stroke, the displacing member 2*b* performs the suction stroke because hydraulic oil is supplied into the cylinder chamber I Ob, with the velocity of the suction stroke greater than that of the pressure stroke. The switch or sensor, respectively, 18*b* enacts the termination of the suction stroke and a transfer to the pressure stroke beginning with the pre-compression of the supply medium. The oil pressure present in the duct 9*b* to the cylinder chamber 5*b* also acts upon the pressure controller 14*b* through the duct 12*b*. Because of the oil pressure acting as a control pressure on this pressure controller through the duct 17*b*, with the oil pressure generated in the cylinder chamber 5*a* of the single pump 1 a performing the supply stroke, the pressure controller remains closed until reaching the opening pressure. As mentioned before, this value is defined by the geometrical conditions in the pressure controller, and of the control pressure. After opening the pressure controller 14*b*, the hydraulic oil supplied to the duct 9*b* flows through the duct 15 to the oil reservoir while maintaining the opening pressure.

Figure 2:
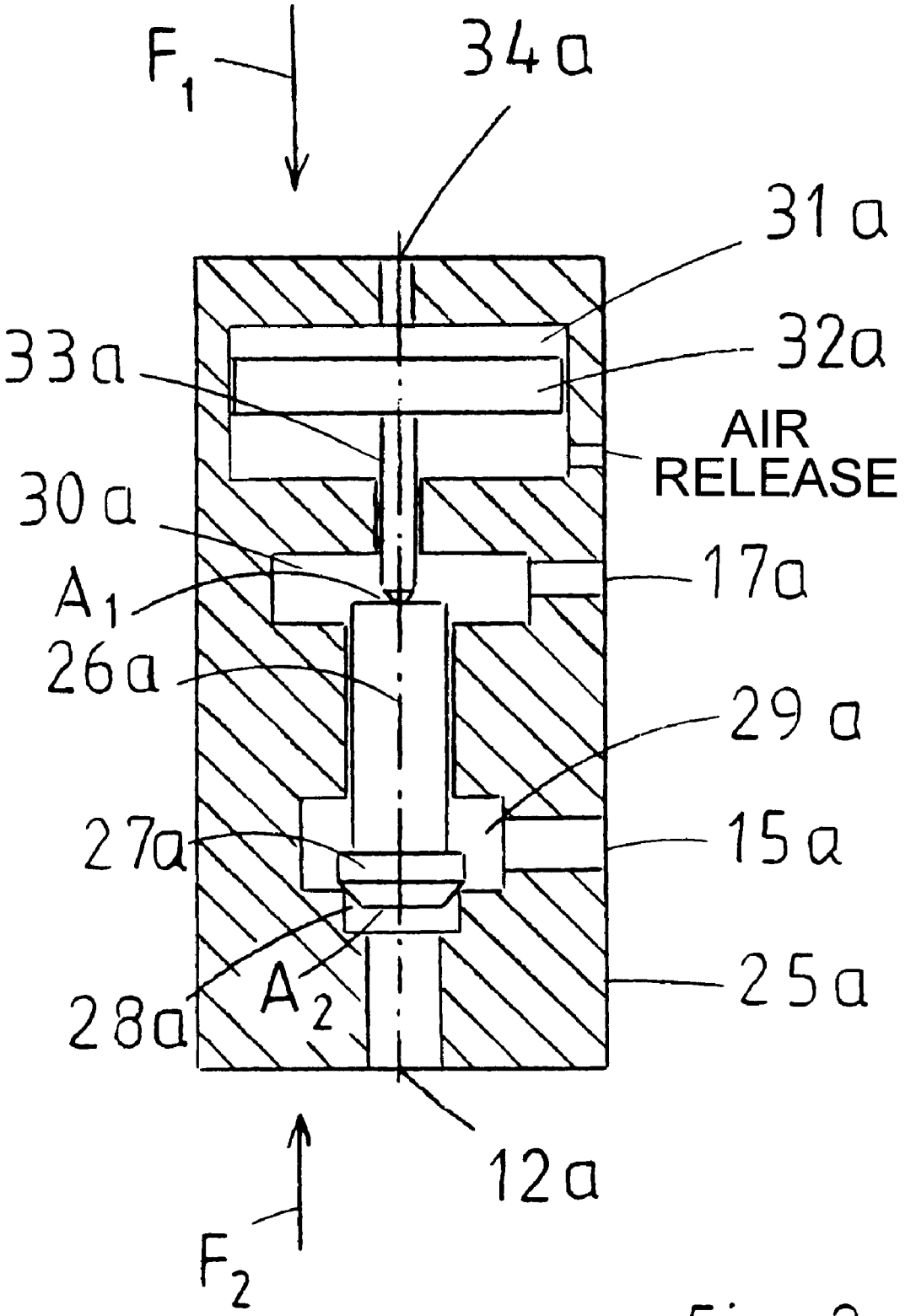
FIG. 2 illustrates one of the two pressure controllers for one of the two hydraulic oil flows to the hydraulic cylinders.

In FIG. 2 one of the two pressure controllers, in this case the pressure controller 14*a*, is illustrated as an example. Both pressure controllers in function the same. In a housing 25*a* there is a slider 26*a* comprising at one end a closing member 27*a* with a cone-shaped projection. This cone will close an aperture 28*a* with a cross section $A_2$ connected with the duct 12*a* and the hydraulic cylinder chamber 5*a*. Towards the closing member 27*a*, the aperture 28*a* is enlarged to a chamber 29*a*. The chamber 29*a* is connected with the duct 15 leading to the hydraulic oil reservoir. The end of the slider 26*a* facing away from the closing member 27*a* has an effective area $A_1$ and, together with the housing 25*a*, forms a chamber 30*a* which is connected with the duct 17*a* and with the hydraulic cylinder chamber 5*b* of the single pump 1*b* supplying medium into the duct 8 to the user.

Furthermore, the housing 25*a* comprises a chamber 31*a* with a piston 32*a*. This piston is connected with a piston rod 33*a* which sealingly projects into the chamber 30*a*, and presses upon the front face of the slider 26*a* when the chamber 31*a* is put under pressure. The pressure medium is supplied to the chamber 31*a* through a duct 34*a*.

Because of the oil pressure in the chamber 30*a*, the force $F_1$ equaling $A_1 \times P$ (5*b*) acts upon the slider 26*a*, wherein P (5*b*) is the hydraulic pressure of the cylinder chamber 5*b*. In the aperture 28*a* a force $F_2$ equaling $A_2 \times P$ (5*a*) and opposite to the force $F_1$ acts upon the slider, wherein P (5*a*) is the hydraulic pressure of the cylinder chamber 5*a* of the pump 1*a* performing the pre-compression stroke. While the force $F_2$ increases from zero with growing pre-compression in the pump chamber 6*a*, and therefore with correspondingly growing hydraulic pressure P (5*a*), the force $F_1$ is constant. When the forces $F_2$ and $F_2$ are equal, the closing force for the aperture 28 becomes zero and hydraulic oil begins to flow from the aperture 28*a* through the chamber 29*a* to the duct 15 while the closing member 27*a* is lifting.

The oil pressure reached corresponds with the final pressure of the pre-compression of the supply medium in the pump chamber 6*a*. At that point the piston displacing member combination 3*a*, 2*a* comes to a stand still. The oil still flowing through the duct 9*a* will flow through the pressure controller 14*a* to the duct 15, wherein the oil pressure in the aperture 28*a* is maintained at a constant value by the force $F_1$ acting upon the aperture. The ratio of the pre-compression final pressure of pump 1*a* to the supply pressure of the pump 1*b* is defined by the area ratio $A_1$ to $A_2$ and is independent of the value of the supply pressure.

When the oil stream through the aperture 28*a* is to be stopped, the pressure controller chamber 31*a* is presented with pressure through the duct 34*a* upon action of the switch 19*b* or 20*b*, respectively, such that the additional force necessary for closing the aperture 28*a* is generated. The piston-displacing member combination 3*a*, 2*a* then performs its pressure stroke from the stand still situation as a supply stroke. By a control not illustrated, the pressure impingement of the pressure controller chamber 31*a* is maintained at least until the end of the supply stroke.

When the outlet valves 7*a* are designed as automatically opening valves, in the example illustrated as check valves, by means of the area ratio $A_1$ to $A_2$ the pre-compression final pressure has to be selected smaller than the supply pressure. In the other case, the valves 7*a*, 7*b* would remain open as a result of the pre-compression pressure raising over the supply pressure in the duct 8. This would mean that now both single pumps would supply into the duct 8. When the outlet valves 7*a*, 7*b* are designed as valves positively controlled with an auxiliary energy, or with an additional close force generated by an auxiliary energy, than the pre-compression final pressure may be selected equal to or larger then the supply pressure.

As is apparent from the foregoing specification, the invention is susceptible of being embodied with various alterations and modifications which may differ particularly from those that have been described in the preceding specification and description. It should be understood that I wish to embody within the scope of the patent warranted hereon all such modifications as reasonably and properly come within the scope of my contribution to the art.

What is claimed is:

1. A method for supplying a liquid medium by means of a pump combination comprising two single oscillating displacement pumps, comprising the steps:

performing a first displacement operation of a first of said pumps to supply said liquid medium at a supply pressure;

during said first displacement operation, starting a compression operation of a second of said pumps to pre-compress the supplied medium to a pre-compression final pressure while maintaining an outlet valve associated with said second pump closed;

stopping said second pump while maintaining said pre-compression final pressure;

continuing said compression operation of said second pump only when said first pump ends its displacement operation; and controlling said pre-compression final pressure of said second pump to a value in proportion with said supply pressure of said first pump.

2. A method according to claim 1, wherein said first pump comprises displacing elements driven by a first hydraulic cylinder having a cylinder chamber with hydraulic fluid therein and a first pressure controller associated with said first hydraulic cylinder and said second pump comprises displacing elements driven by a second hydraulic cylinder having a cylinder chamber with hydraulic fluid therein and a second pressure controller associated with said second hydraulic cylinder, further comprising the steps:

directing a pressure of said hydraulic fluid from said first cylinder chamber to a first side of a first movable closing member in said first pressure controller, said first side of said first closing member having an effective area $A_1$, directing said pressure of said hydraulic fluid from said first cylinder chamber to a second side of a second movable closing member in said second pressure controller, said second side of said second closing member having an effective area $A_2$, directing a pressure of said hydraulic fluid from said second cylinder chamber to a first side of said closing member in said second pressure controller, said first side of said second closing member having an effective area $A_1$, and directing said pressure of said hydraulic fluid from said second cylinder chamber to a second side of a closing member in said first pressure controller, said second side of said first closing member having an effective area $A_2$.

3. A method according to claim 2, wherein when the pressure of said hydraulic fluid from said first cylinder chamber times $A_2$ is greater than the pressure of said hydraulic fluid from said second cylinder times $A_1$, said second movable closing member will move, causing an aperture to open to allow hydraulic fluid to flow from said first cylinder chamber to a reservoir, and when the pressure of said hydraulic fluid from said second cylinder chamber times $A_2$ is greater than the pressure of said hydraulic fluid from said first cylinder times $A_1$, said first movable closing member will move, causing an aperture to open to allow hydraulic fluid to flow from said second cylinder chamber to a reservoir.

4. A method according to claim 3, wherein said flows of hydraulic fluid from said first cylinder chamber to said reservoir and from said second cylinder chamber to said reservoir continue until a signal is sent which corresponds to a pressure defined by an area ratio of $A_1$ to $A_2$ is presented at said second side of said respective closing member.

5. A method according to claim 4, wherein a additional force is applied to said first side of said respective movable closing members to terminate flow of hydraulic fluid from said first cylinder chamber and said second cylinder chamber to said reservoir when said respective first and second pump stops at an end of its pre-compression stroke.

6. A method according to claim 5, wherein said additional force is exerted upon said closing member by a piston impinged by a pressurized medium.

7. An apparatus for supplying liquids by means of a pump combination comprising two single oscillating displacement pumps comprising a first oscillating displacement pump having displacement elements driven by a first hydraulic cylinder through a movable piston, a second oscillating displacement pump having displacement elements driven by a second hydraulic cylinder through a movable piston, a first pressure controller associated with said first hydraulic cylinder having a first movable closing member therein, said first movable member carried in a bore having a first end with a surface area of A1 and a second end with a surface area A2, a second pressure controller associated with said second hydraulic cylinder having a second movable closing member therein, said second movable member carried in a bore having a first end with a surface area of A1 and a second end with a surface area A2, a first hydraulic fluid line extending from said first hydraulic cylinder to said second end of said first movable member and to said first end of said second movable member, a second hydraulic fluid line extending from said second hydraulic cylinder to said second end of said second movable member and to said first end of said first movable member, said first pressure controller further comprising a means to allow hydraulic fluid to flow from said first hydraulic cylinder to a reservoir when the pressure of hydraulic fluid in said first hydraulic cylinder multiplied by said area A2 is greater than the pressure of hydraulic fluid from said second hydraulic cylinder multiplied by said area A1, and said second pressure controller further comprising a means to allow hydraulic fluid to flow from said second hydraulic cylinder to a reservoir when the pressure of hydraulic fluid in said second hydraulic cylinder multiplied by said area A2 is greater than the pressure of hydraulic fluid from said first hydraulic cylinder multiplied by said area A1.

8. An apparatus according to claim 7, wherein a switch is provided in association with each hydraulic piston to determine a position of said piston and to close and thereby transmit a signal when said piston moves to a predetermined position.

9. An apparatus according to claim 8, wherein a first force applying piston rod engages said first end of said first movable member and a second force applying piston rod engages said first end of said second movable member, and said signal causes a pressure to be applied to one of said first and second piston rods to move a respective one of said movable members.

* * * * *